US006430782B1

(12) United States Patent
Torres et al.

(10) Patent No.: US 6,430,782 B1
(45) Date of Patent: Aug. 13, 2002

(54) CIGARETTE LIGHTER CLIP

(76) Inventors: David Torres, 6100 Meadowhill Dr.; Martin Moberly, 4311 Martin Pkwy., both of Colleyville, TX (US) 76034

( * ) Notice: Subject to any disclaimer, the term of this patent is extended or adjusted under 35 U.S.C. 154(b) by 0 days.

(21) Appl. No.: 09/606,321

(22) Filed: Jun. 28, 2000

(51) Int. Cl.[7] ..... A44B 21/00; A42F 15/10; B65D 85/10

(52) U.S. Cl. ..... 24/3.1; 24/3.12; 24/339; 24/545; 24/570; 24/DIG. 11; 206/87; 206/89

(58) Field of Search ..... 24/570, 335, 329, 24/545, 3.12, 3 R, DIG. 11

(56) References Cited

U.S. PATENT DOCUMENTS

| | | | | | |
|---|---|---|---|---|---|
| 1,589,228 | A | * | 6/1926 | Robb | 24/545 |
| 2,586,039 | A | * | 2/1952 | Heggedal | 24/DIG. 11 |
| 2,815,595 | A | * | 12/1957 | Davis | 24/DIG. 11 |
| 3,057,180 | A | | 10/1962 | Steppan | |
| D195,731 | S | | 7/1963 | Steppan | D48/27 |
| 3,836,055 | A | * | 9/1974 | Cooper | 24/339 |
| 3,968,874 | A | | 7/1976 | Corey | 206/248 |
| 3,976,194 | A | | 8/1976 | Loredo | 206/87 |
| 3,983,602 | A | * | 10/1976 | Barry | 24/3 R |
| 4,000,812 | A | | 1/1977 | Pisarski et al. | 206/87 |
| D246,912 | S | | 1/1978 | Adelhardt | D27/51 |
| 4,082,496 | A | | 4/1978 | Johnson | 431/343 |
| 4,176,773 | A | | 12/1979 | Wilkinson | 224/205 |
| 4,190,148 | A | | 2/1980 | Schade, II et al. | 206/89 |
| 4,223,784 | A | | 9/1980 | Kaneyasu | 206/88 |
| 4,230,224 | A | | 10/1980 | Weeks | 206/87 |
| 4,252,237 | A | | 2/1981 | Baclit | 206/86 |
| 4,281,761 | A | | 8/1981 | Olazabal | 206/87 |
| D260,689 | S | | 9/1981 | Storms | D27/37 |
| D261,775 | S | | 11/1981 | Valigura | D19/56 |
| 4,303,154 | A | | 12/1981 | Hicks | 206/86 |
| 4,363,432 | A | | 12/1982 | Warthen | 224/247 |
| D267,590 | S | | 1/1983 | Varma | D27/51 |
| 4,385,689 | A | | 5/1983 | Olazabal | 206/87 |
| D273,426 | S | | 4/1984 | Zucker | D27/49 |
| 4,486,169 | A | | 12/1984 | Lewis | 206/85 |
| D277,034 | S | | 1/1985 | Ramsdell | D27/48 |
| 4,579,222 | A | | 4/1986 | Olazabal | 206/87 |
| 4,588,076 | A | | 5/1986 | Caputo et al. | 206/86 |
| 4,710,992 | A | * | 12/1987 | Falwell et al. | 24/545 |
| 4,750,613 | A | | 6/1988 | Kopp | 206/87 |
| 4,765,459 | A | | 8/1988 | Edwards | 206/38.1 |
| D298,781 | S | | 12/1988 | Thomas | D3/103 |
| 4,844,254 | A | | 7/1989 | Jang | 206/236 |
| D303,159 | S | | 8/1989 | Heath | D27/172 |
| 4,852,729 | A | | 8/1989 | Conte | 206/86 |
| D313,085 | S | | 12/1990 | Eisenbraun | D27/142 |
| 5,088,684 | A | | 2/1992 | Torras et al. | 248/682 |
| 5,277,315 | A | | 1/1994 | Plein | 206/270 |
| D350,216 | S | | 8/1994 | Heaton | D27/144 |
| 5,409,374 | A | | 4/1995 | Liard | 431/253 |
| D372,333 | S | | 7/1996 | Pearson | D27/144 |
| 5,542,159 | A | * | 8/1996 | Schultz et al. | 24/545 |
| 5,606,777 | A | * | 3/1997 | Lu | 24/545 |
| 5,642,557 | A | * | 7/1997 | Clews | 24/339 |
| 5,740,905 | A | | 4/1998 | Kilfoy | 206/87 |
| 5,746,587 | A | | 5/1998 | Racine et al. | 431/253 |
| 5,788,479 | A | | 8/1998 | Galanos et al. | 431/253 |
| D402,400 | S | | 12/1998 | Pausinger | D27/161 |
| 5,918,734 | A | | 7/1999 | Devens et al. | 206/87 |

* cited by examiner

*Primary Examiner*—Victor Sakran
(74) *Attorney, Agent, or Firm*—Hill & Hunn LLP

(57) ABSTRACT

A lighter clip for use with a cigarette pack is inexpensively manufactured from a material such as injection-molded plastic. A generally three-sided clip is sized and shaped to fit across the width and depth of the pack, and contains an arcuate portion, suitable for holding a lighter, on one end. The clip is manufactured from a resilient material, and shaped in a manner that causes it to be lightly biased against the pack, thereby holding the clip in position. The two longer clip arms are sized to have a large enough surface area to be suitable for promotional use, and the clip arms and ends are shaped to securely grip the cigarette pack.

12 Claims, 3 Drawing Sheets

CIGARETTE LIGHTER CLIP

BACKGROUND OF THE INVENTION

1. Field of the Invention

The present invention relates generally to smoking accessories, and more particularly to a clip for holding together a cigarette lighter and a pack of cigarettes.

2. Description of the Prior Art

Cigarettes are generally sold in packages of twenty, or larger cartons containing a number of such packages. Cigarette packs have been standardized at a small number of sizes corresponding to standard product lengths. To accommodate various length cigarettes, the packs have different heights, but the width and depth are essentially the same for all sizes.

Some type of heat source must be used to light the cigarette, and the best sources are easily portable. Pocket lighters or matches are the most common portable forms for lighting cigarettes. Other, less portable devices, such as electric lighters in automobiles, are also common.

The disposable butane lighter is widely used. Different models are available, with a height of approximately three inches and a generally oval or rectangular cross-section. These lighters are very inexpensive, so that losing one causes no financial hardship to the smoker.

However, losing a lighter causes an extreme convenience hardship to the smoker. It becomes necessary to borrow a lighter or other heat source from someone else. Because these articles are so easily misplaced, it is not an uncommon sight to see several smokers at the same time trying to find someone with a lighter.

Numerous attempts have been made in the past to provide acceptable devices for attaching lighters to cigarette packs. Invariably, these devices have not faired well in the marketplace, generally because of expense or convenience issues. For example, U.S. Pat. No. D261,775 teaches a lighter clip which grips a typical disposable lighter, and has a flexible clip for insertion into a protective sleeve over a cigarette pack. Although this clip grips the lighter securely, it suffers from the problem that the lighter and clip can too easily become detached from the cigarette pack. Numerous designs shown and described in the prior art suffer from this problem, such as U.S. Pat. No. 5,088,584, which teaches a similar device which clips to the underside of the pack.

Another approach is illustrated by U.S. Pat. No. 4,852,729, which teaches the use of a five-sided rectangular box having a divider near one end. A smaller compartment defined in the box is used for holding a lighter, while the larger compartment is sized to accept a cigarette pack. Such devices have not become widely used in the marketplace, presumably for reasons of cost. Another class of devices generally includes the cigarette lighter as an integral part of the clip design, as shown by U.S. Pat. No. D260,689. Such devices have presumably not become popular for reasons of cost and complexity, and are not usable with the ubiquitous disposable lighter.

It would be desirable to provide an improved lighter clip for cigarette packs which overcomes the limitations of the prior art. It would further be desirable for such a product to be inexpensive, and convenient to use. It would also be desirable for such a product to be capable of containing advertising so as to be suitable for use as a promotional product.

SUMMARY OF THE INVENTION

In accordance with the present invention, a lighter clip for use with a cigarette pack is inexpensively manufactured from a material such as injection-molded plastic. A generally three-sided clip is sized and shaped to fit across the width and depth of the pack, and contains an arcuate portion, suitable for holding a lighter, on one end. The clip is manufactured from a resilient material, and shaped in a manner which causes it to be lightly biased against the pack, thereby holding the clip in position. The two longer clip arms are sized to have a large enough surface area to be suitable for promotional use, and the clip arms and ends are shaped to securely grip the cigarette pack.

BRIEF DESCRIPTION OF THE DRAWINGS

The novel features believed characteristic of the invention are set forth in the appended claims. The invention itself however, as well as a preferred mode of use, further objects and advantages thereof, will best be understood by reference to the following detailed description of an illustrative embodiment when read in conjunction with the accompanying drawings, wherein:

DESCRIPTION OF THE PREFERRED EMBODIMENT

The lighter clip of the present invention provides an extremely clean and simple design which is highly functional and very inexpensive to manufacture. In this industry, a truly inexpensive product could be considered practically synonymous with one that is free to the consumer. The present design can be manufactured so inexpensively that it can be given away.

This capability of being given free to the consumer enables the preferred clip design to be useful as a promotional product. The preferred design includes at least two surfaces which are capable of, and suitable for, carrying advertising such as logos, brand names, and the like. This means that this clip cannot only be given free to the consumer for purposes of convenience, but then has an extended life as an ongoing advertising item.

Figure 1:
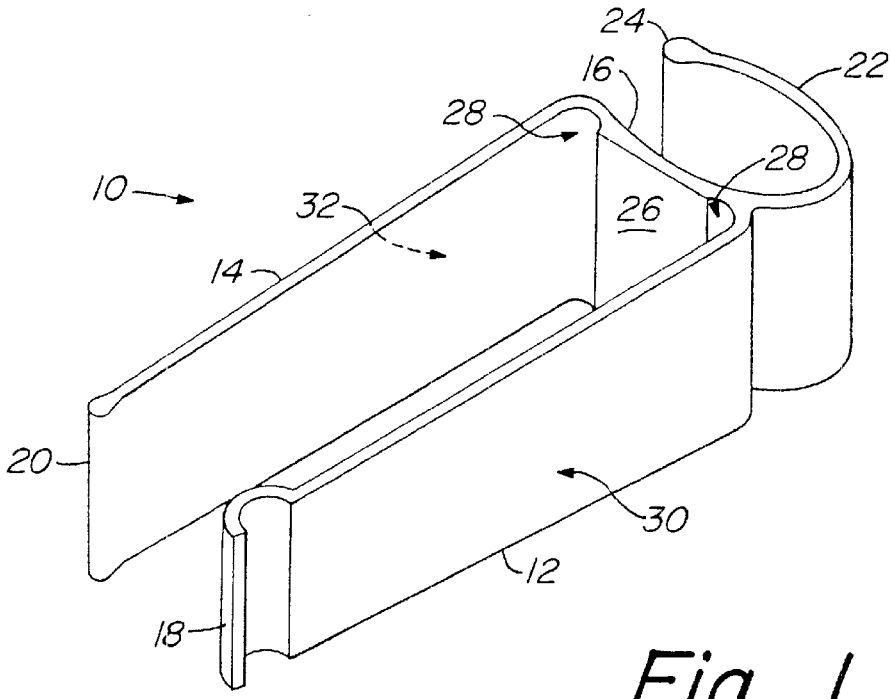
FIG. 1 is a perspective view of a lighter clip in accordance with the present invention.

Referring to FIG. 1, a lighter clip 10 is shown in perspective view. Clip 10 has a first arm 12 and a second arm 14 connected by a bridge 16. First arm 12 has a tip 18, and second arm 14 has a tip 20. A curved holder portion 22 is connected to, and formed integral with, bridge 16. Holder 22 has a tip 24 on its free end.

Arms 12 and 14 are sized so that the width of a cigarette pack just fits along their length between a flat portion 26 of the bridge and the nearest portion of the tips 18, 20. For a standard pack having a width of approximately 2¼ inches, arms 12, 14 preferably have approximately the same length along the flat portion. Arms 12,14 have a length such that the edge of the cigarette pack away from bridge 16 is held by the tips as they project towards each other. Tip 20 provides a slight resistance to the cigarette pack being slid out of the arms, while the more curved first arm tip 18 provides greater resistance to removal of the pack.

The bridge 16 spaces arms 12, 14 a distance apart approximately equal to the depth of a standard cigarette pack, approximately ⅞ inch. As can be seen more clearly from the top view of FIG. 2, arms 12, 14 are not perfectly parallel. Instead, they are slightly farther apart where they connect to bridge 16 than at the ends adjacent tips 18, 20. In the preferred embodiment, the inner surfaces of arms 12, 14 are approximately ⅞ inch apart and adjacent the bridge 16, and approximately 13/16 inch apart adjacent the tips 18, 20 with no cigarette pack inserted. At their closest approach, tips 18, 20 are preferably approximately ⅝ inch apart with no pack inserted. These dimensions are preferably adjusted slightly as needed to accommodate different sizes, as not all cigarette packs have exactly the same dimensions.

Figure 2:
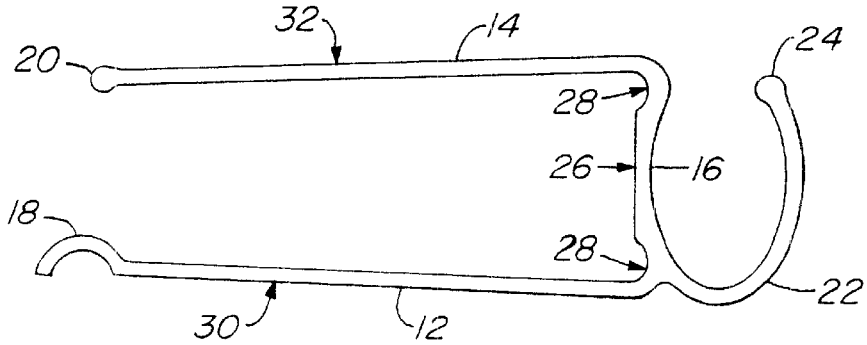
FIG. 2 is a top view of the lighter clip of FIG. 1.

Clip 10 is preferably formed from an injected molded plastic, such as glass-filled plastic, polyethylene or polypropylene having an appropriate density. The physical properties of the material to be used will depend upon, and will influence, the thicknesses of various parts of the clip 10. The values may be easily selected by those of ordinary skill in the art to achieve a stiffness or flexibility of the clip 10 which is desired. Variation of material or thickness may necessitate variations in the preferred measurements set forth above in order to provide an appropriate gripping force for arms 18, 20 against the cigarette pack. The stiffness of arms 12, 14 is also influenced by the thickness of the plastic used in clip 10 at the corners where arms 12, 14 join the bridge 16. As shown in FIGS. 1 and 2, arcuate cutouts 28 are provided to provide more flexibility for this design. If more stiffness is desired, meaning that tips 18, 20 and the ends of arms 12, 14 adjacent tips 18, 20, respectively, grip harder against the cigarette pack, the size of arcuate cutouts 28 may be diminished or eliminated.

Holder portion 22 is used to grip a typical disposable lighter. It is curved in an approximately oval shape to fit snugly against lighters having that cross-section. Lighters having other cross-sections, such as approximately rectangular, will often fit in holder 22. If desired, the shape of holder 22 can be altered to specifically conform with lighters having a different cross-section. Tip 24 provides a resistance to the removal of the lighter from holder 22.

The resistance provided by the holder to removal of the lighter is primarily determined by the thickness of the walls of holder 22. This thickness should be selected so that the lighter can easily be snapped into place and removed when desired, but will not come out accidentally during normal transportation of the assembly of cigarette pack, clip, and lighter.

It will be appreciated that when a cigarette pack is held by clip 10, two primary surfaces remain which are visibly exposed. These are outer surfaces 30, 32 of arms 12, 14, respectively. Clip 10 is preferably constructed so that surfaces 30, 32 have a height of approximately ½ inch to 1 inch, with approximately ¾ inch being a generally satisfactory value. This size results in a surface on either size of the clip which is approximately ¾ inch by 2½ inches in area, a substantial area of flat surface suitable for advertising or display of other promotional materials.

Figure 5:
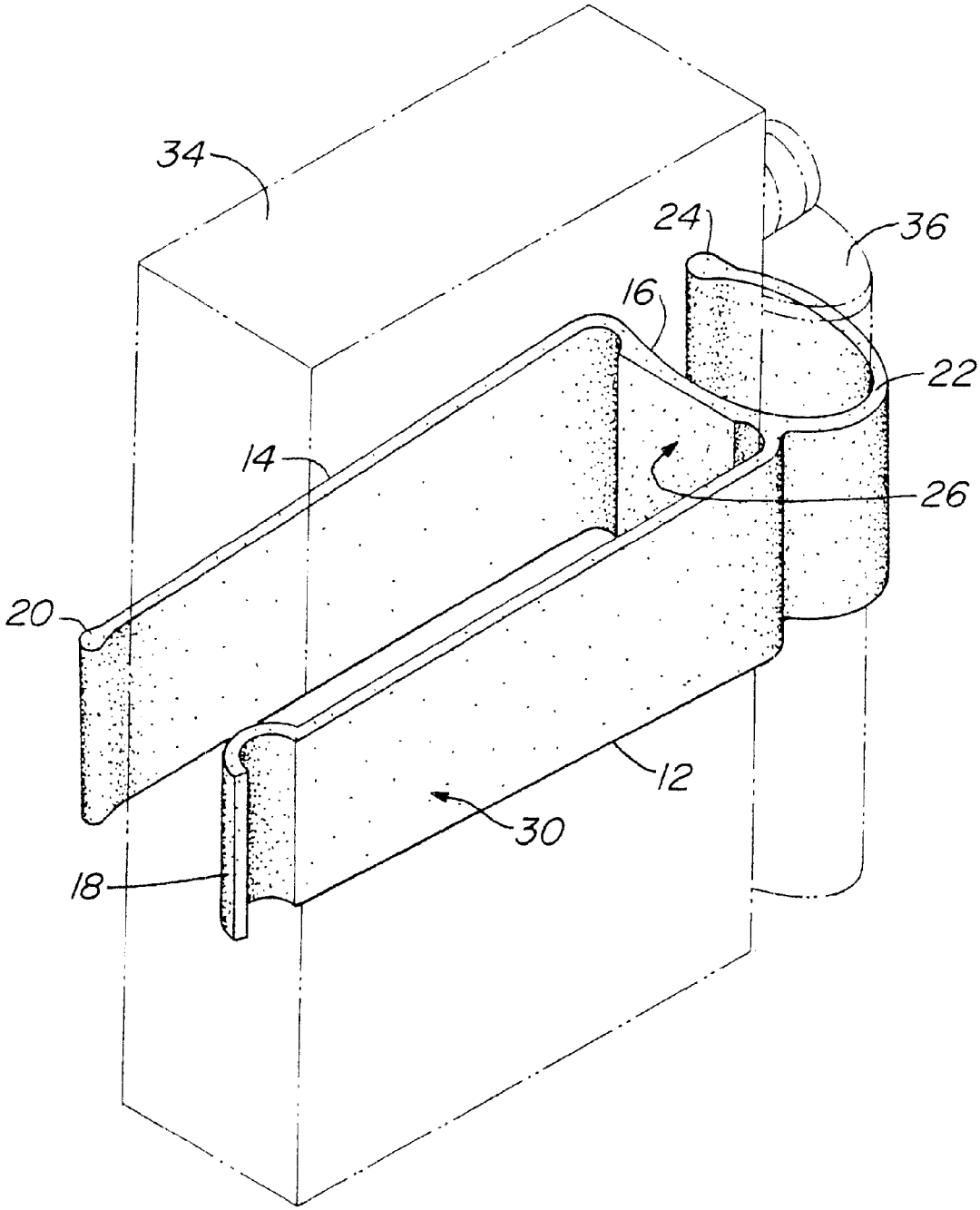
FIG. 5 shows a perspective view of the first embodiment containing a cigarette pack and a lighter in phantom.

FIG. 5 shows clip 10 containing a cigarette pack 34 and a lighter 36 in phantom. As shown in FIG. 5, it will be seen that arms 12, 14 cover a substantial portion of two faces of a cigarette pack 34, providing prime promotional opportunities for those interested in advertising their products to smokers. For example, surfaces 30, 32 can be marked to contain any logos or inscriptions that may be of interest to smokers. Local and national businesses can promote their products and services.

Figure 3:
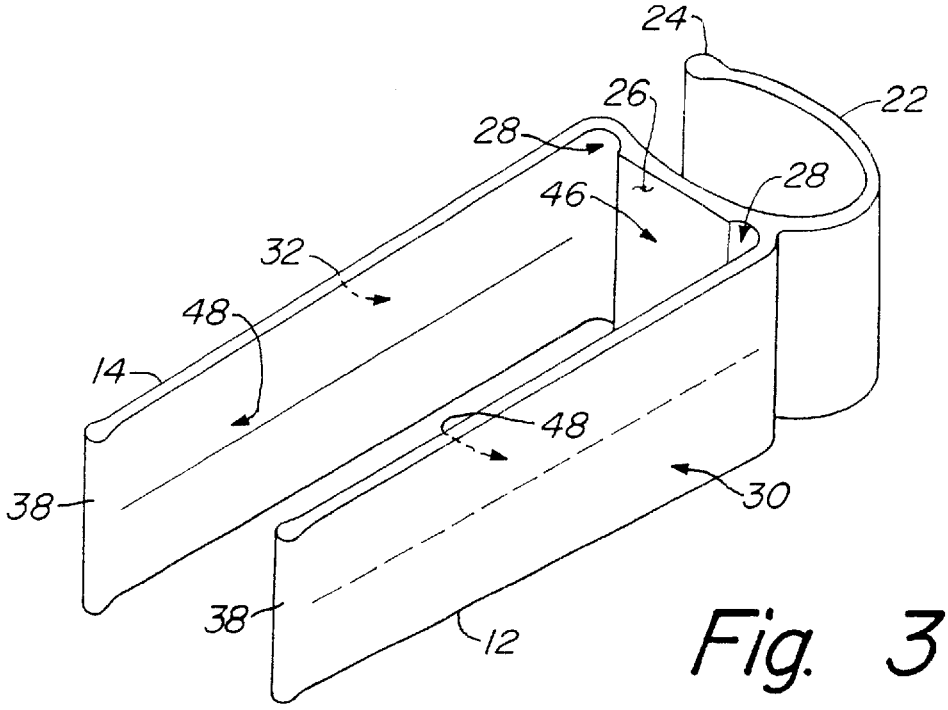
FIG. 3 is a perspective view of a first alternative embodiment for the lighter clip of FIG. 1.

Variations in design details from the embodiment shown in FIGS. 1 and 2 may be used if desired. For example, the embodiment of FIG. 3 illustrates a clip 10 in which arms 12 and 14 both have small tips 38 on the ends. This design allows the cigarette pack to be more easily inserted into and removed from clip 10, but lessens slightly the gripping capacity of clip 10. Instead, if a greater capacity for gripping the cigarette package is desired, two arcuate tips such as tip 18 of FIG. 1 can be used instead of the one shown in that embodiment.

Figure 4:
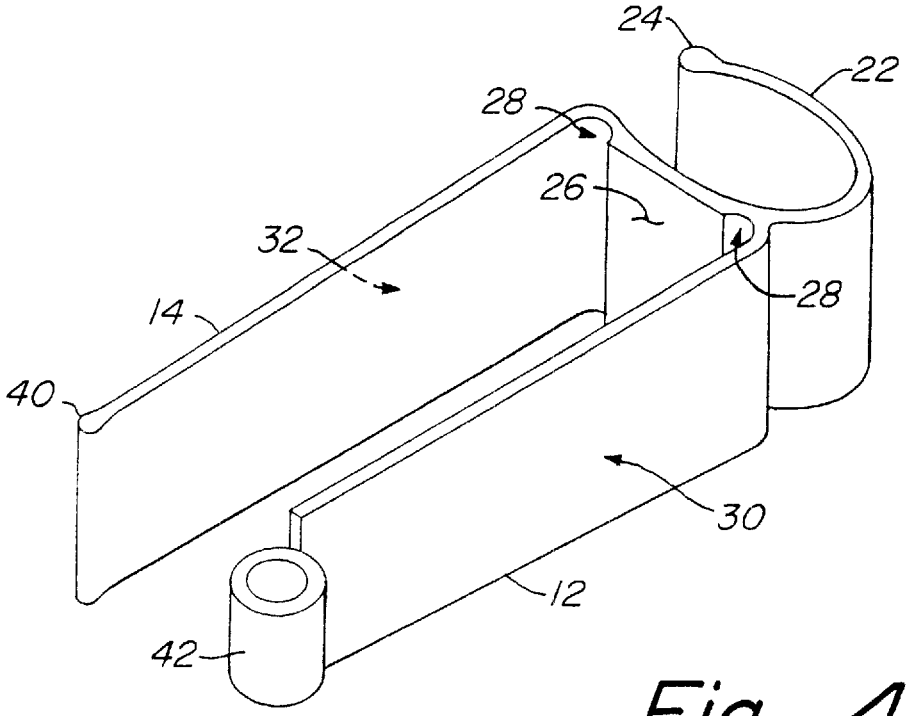
FIG. 4 is a perspective view of a second alternative embodiment of the lighter clip of FIG. 1.

Referring to FIG. 4, a variation is shown in which arm 14 has a small tip 40, while arm 12 has a tip 42 which is a completed ring. This provides a central opening 44 which is preferably a few sixteenths of an inch in diameter. Opening 44 is suitable for allowing clip 10 to be attached to a key chain or similar device, allowing the clip and its contents to be easily kept track of.

Various provisions may be made for enhancing the surface friction between the inner surfaces of arms 12, 14 and the cigarette pack. Several of these are shown in FIG. 3. Bridge flat 26 already provides an increased surface contact area between bridge 16 and a side panel of the cigarette pack. Bridge flat 26 may be textured with grooves 46, or other texture patterns, to increase its surface roughness. This will increase the resistance of the clip to movement of the cigarette pack in a roughly up and down direction as shown in FIG. 3.

Various texturizing may also be performed to the inner surfaces of arm 12, 14. One such texturizing technique is to provide one or more ridges 48 on the inner surfaces of arms 12, 14 that are parallel with the length of the arms. These ridges will oppose movement of the pack in the same up down direction as provided by texturizing 46.

In general, the tips on the end of arms 12, 14 provide the primary resistance to the pack being removed from the clip in a lateral direction, perpendicular to the plane of bridge flat 26. However, particularly on the ends half of arms 12, 14 adjacent the tips, cross-hatching or other texturizing techniques can be applied to provide some additional resistance to removal of the pack. Because the stiffness of the clip 10 can be adjusted by changing the material used to make it, and the thickness of its various portions, generally surface texturing is not the primary means for providing resistance to a lateral removal of the cigarette pack from the clip 10.

In addition to texturizing, layers of tacky material can be applied by adhesive to the inner surfaces of arms 12, 14, or molded into the arms themselves when the clip is made. Textured surfaces or a layer of tacky material can also be added to the inner surface of holder portion 22 to prevent vertical movement of the lighter with respect to the clip. Because the lighter has rigid sides, holder portion 22 can be sized to grip the lighter more tightly than arms 12,14 can grip the soft sided cigarette pack. This will decrease the likelihood that the lighter will slide within the holder 22. If greater resistance to sliding is required, however, texture or other techniques can be used to prevent slippage.

Numerous methods can be used for applying advertising or other promotional material to arm outer surfaces 30, 32. Additional objects can be attached with any kind of adhesive or fastener. Logos or other information and brand names can be inscribed directly into the surface, or paint or other pigments can be applied directly to these surfaces. The basic color of the clip can be any desired color, selected during molding, and chosen to complement the advertising to be used. In some instances, it may be possible to directly mold promotional items into the surface at the time the clip is molded. Embossing and debossing techniques can be used to provide interesting features. These and similar techniques will be understood by, and easily implemented by, those skilled in the art.

The design described herein has several advantages over designs previously available in the art. One important advantage is that the design is one which is easily fabricated with inexpensive injection molding equipment, so that the per item actual fabrication cost of the clip is extremely low. Due to its extremely low cost, it can be given away to customers as a free promotional item.

In addition, the various details of the design allow the clip to reliably grip a cigarette pack, yet simultaneously allow the cigarette pack to be easily inserted and removed when desired. Arms 12, 14 are angled slightly toward each other at the tips, so that insertion of a cigarette pack places these arms under tension. They will thus therefore be providing a light compressive force against the cigarette pack, particularly at the side opposite bridge 16, at all times. The selection of appropriate tips at the end of arms 12, 14 greatly enhances the gripping ability of the clip. Because there is significant surface area, under tension, between the clip and the cigarette pack, it is reliably held in place within the clip against both vertical and lateral movement forces.

In addition, the present design provides an improved technique for gripping the lighter. In a preferred design, the lighter is inserted through an opening at the end of the oval shape, as seen in the view of FIG. 2, as opposed to through a relatively flatter side. This allows the flexibility of the holder 22 to more easily both grip the lighter securely, and yet not provide difficulties when it is desired to have the lighter removed. Because of a longer arm, the opening for the lighter can change by a larger amount without applying a large strain to the opposite end of holder 22, which is the primary bending location when the lighter is inserted and removed.

Variations for the arm tips are also possible. Several have been described, but others that accomplish the same function may be suitable. Any tip design must accomplish two primary goals: insertion of the cigarette pack must be easy, while removal preferably only occurs intentionally. While arms 12, 14 press lightly against the cigarette pack to retain it in position, extreme pressure will crumple the pack. The tips, rounding the comers of the cigarette pack, translate lateral movement of the pack into a spreading force on the arms. Any type of curved or sloped inner surface on the tips may be used for this function.

Preferably, all comers and edges are molded to be slightly rounded. This prevents the clip from becoming snagged on clothing and other similar materials.

While the invention has been particularly shown and described with reference to a preferred embodiment, it will be understood by those skilled in the art that various changes in form and detail may be made therein without departing from the spirit and scope of the invention.

What is claimed is:

1. A clip for a cigarette pack and lighter, comprising:

first and second clip arms, each having a near end and a far end;

a bridge connected to the near ends of the first and second clip arms, wherein the first and second clip arms extend from the bridge in a first direction a distance suitable for holding a cigarette pack;

a lighter clip connected to the bridge and extending away therefrom in a second direction away from the first direction, the clip adapted to retain a cigarette lighter, wherein the lighter clip is longer in a direction approximately parallel to the bridge than in a direction approximately parallel to the clip arms, wherein the lighter clip has a cross section approximately the same shape as a lighter; and tips connected to the clip arm far ends, the tips extending towards each other a distance sufficient to retain the cigarette pack in the clip.

2. The clip of claim 1, wherein the tips each comprise enlargements in the clip arms having a thickness approximately twice that of the clip arms.

3. The clip of claim 1, wherein the first clip arm tip comprises a curved projection having a cross-section which is an arc of a circle.

4. The clip of claim 3, wherein the first clip arm tip has a cross-section which is approximately semi-circular.

5. The clip of claim 1, wherein the first clip arm tip comprises a tube.

6. The clip of claim 1, wherein the clip arms are angled to be closer together at the far ends than at the near ends, whereby the clip arms are biased against the cigarette pack when the cigarette pack is inserted into the clip.

7. The clip of claim 1, wherein the clip arms each have an outer surface which is substantially flat, whereby the outer surfaces are adapted to display written and graphic information.

8. The clip of claim 1, wherein the clip arms each have an inner surface adapted to provide friction to resist movement of the cigarette pack when it is inserted into the clip.

9. The clip of claim 8, wherein the clip arm inner surfaces are textured.

10. The clip of claim 8, wherein the clip arm inner surfaces each have a layer of tacky material thereon.

11. The clip of claim 1, wherein the lighter clip further has an opening on an end near the first clip arm, whereby the lighter clip opening is on a short end of its cross-section.

12. The clip of claim 1, wherein the lighter clip cross-section is approximately oval.

* * * * *